US005329730A

United States Patent [19]

Scheider et al.

[11] Patent Number: 5,329,730

[45] Date of Patent: Jul. 19, 1994

[54] ABRASIVE FINISHING TOOL

[75] Inventors: Alfred E. Scheider, Orange; R. Brown Warner, Westlake, both of Ohio

[73] Assignee: Jason, Inc., Cleveland, Ohio

[21] Appl. No.: 519,632

[22] Filed: May 7, 1990

Related U.S. Application Data

[63] Continuation-in-part of Ser. No. 409,680, Sep. 20, 1989, abandoned, Ser. No. 216,710, Jun. 8, 1988, and Ser. No. 471,385, Jan. 1, 1990.

[51] Int. Cl.[5] ..... B24B 9/02

[52] U.S. Cl. ..... 51/334; 51/337; 51/400; 15/159.1; 15/207

[58] Field of Search ..... 51/337, 332, 334, 336, 51/400; 300/16; 15/159 R, 159 A, 162, 164, 207

[56] References Cited

U.S. PATENT DOCUMENTS 2,049,324 7/1936 Schneider ..... 51/337

4,828,420 5/1989 Otsuka et al. ..... 15/159 A

OTHER PUBLICATIONS

Translation of Japanese Laid Open Patent Publication No. 59-175959.

*Primary Examiner*—M. Rachuba

*Attorney, Agent, or Firm*—Renner, Otto, Boisselle & Sklar

[57] ABSTRACT

An abrasive grinding tool and method for making the same characterized by a shaft having a longitudinal axis and a relatively thin flat bundle of monofilaments. The bundle is secured to the shaft and projects radially outwardly from two sides of the shaft in a direction generally perpendicular to the longitudinal axis. The shaft may comprise a wire having two securing sections twisted beyond the bundle to form a twisted stem. In one embodiment of the invention, the bundle has intermediate and end sections positioned generally in a plane passing through the longitudinal axis of the shaft. In an alternative embodiment, the end sections are bent circumferentially away from the intermediate sections forming a predetermined bend on each side of the shaft. In another embodiment of the invention, the securing sections of the wire stem are twisted whereby the monofilaments project radially outwardly in a helical pattern.

45 Claims, 3 Drawing Sheets

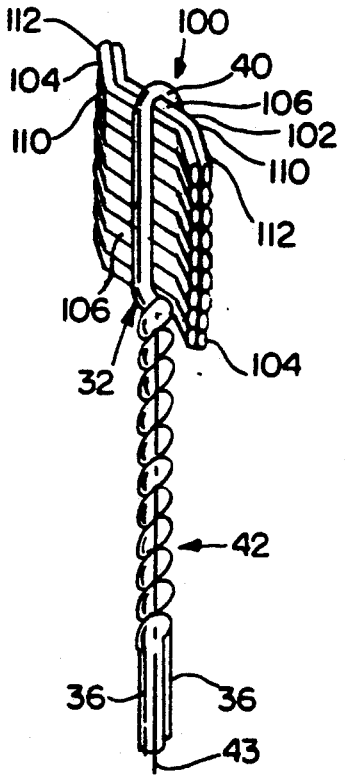
FIG. 7
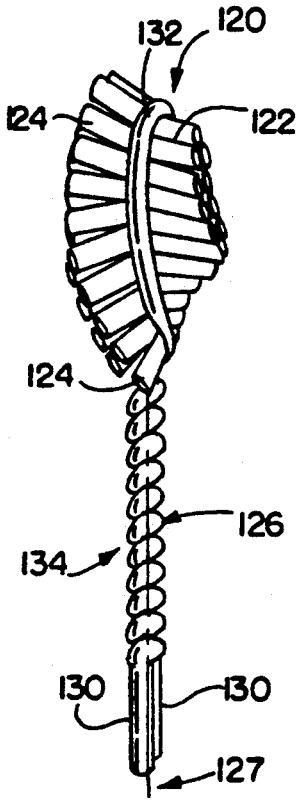
FIG. 9
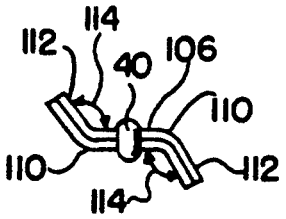
FIG. 8
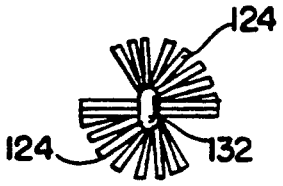
FIG. 10
FIG. 12
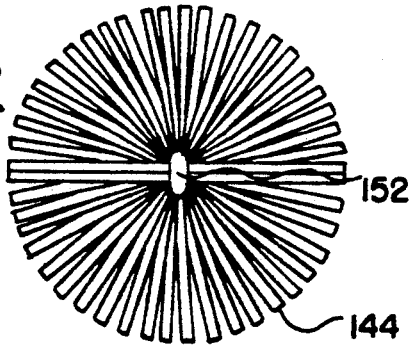
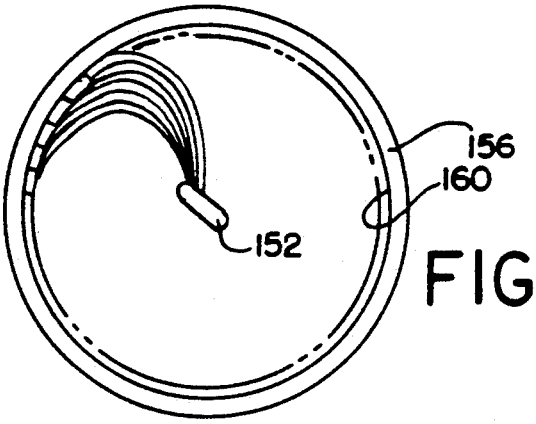
FIG. 13
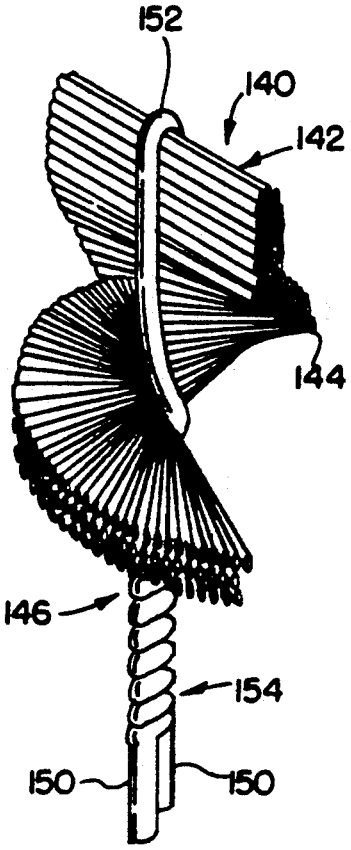
FIG. 11

ABRASIVE FINISHING TOOL

RELATED APPLICATION

This application is a continuation-in-part of applicants' copending application entitled "Abrasive Finishing Tool", Ser. No. 409,680, filed Sep. 20, 1989; now abandoned applicants' copending application entitled "Rotary Abrasive Tool and Filament Therefor", Ser. No. 216,710, filed Jun. 8, 1988; and applicants' copending application entitled "Abrasive Tool and Method of Making", Ser. No. 471,385, filed Jan. 1, 1990. The entire disclosures of the above-identified copending applications are hereby incorporated by reference.

DISCLOSURE

This invention relates generally as indicated to a flexible abrasive grinding tool and more particularly to a rotary abrasive brush or hone secured to a shaft ideally suited for finishing interior cylindrical surfaces. The invention also relates to a method of making the tool.

BACKGROUND OF THE INVENTION

Rotary abrasive tools particularly designed for cleaning or finishing interior cylindrical surfaces may be used in many settings. If a side of a filament instead of the tip can be properly positioned against the surface to be honed or finished, it has been found more work per unit time can be achieved. This is especially true when the filament has a flat side facing the direction of rotation. This positioning is advantageous in finishing and cleaning the interior of the cylinder and also at the edges of a structure. A flexible abrasive rotary tool is disclosed in copending application entitled "Flexible Abrasive Grinding Tool", Ser. No. 216,709, filed Jun. 8, 1988. The present invention relates to certain improvements in the type of tool disclosed in such copending application relating to smaller and more economical tools utilizing flat sided and other shaped monofilaments.

SUMMARY OF THE INVENTION

The present invention provides an abrasive grinding tool comprising a shaft having a longitudinal axis and a relatively thin flat bundle of monofilaments. The thin flat bundle of monofilaments has a central section, two end sections and two intermediate sections between the central section and the end sections. The central section is secured to the shaft whereby the intermediate sections of the bundle project radially outwardly from two sides of the shaft in a direction generally perpendicular to the longitudinal axis. Each monofilament in the bundle has a generally rectangular sectional shape and has an abrasive material embedded substantially homogeneously therein throughout. The shaft may comprise a wire having a securing section and two stem sections surrounding the securing section. The securing section encloses the bundle and the stem sections are twisted beyond the bundle to form a twisted stem. The rectangular sectional shape of the monofilament has a width dimension and a thickness dimension, and the width dimension is at least twice the magnitude of the thickness dimension whereby each monofilament is at least twice as wide as it is thick. The monofilaments are oriented so that the width dimension is generally parallel to the longitudinal axis of the shaft or stem. The monofilaments are loaded with at least 30% by weight of abrasive material and more preferably about 45% by weight of abrasive material. In one embodiment of the invention, the intermediate sections are positioned generally in a plane passing through the longitudinal axis of the shaft and the end sections are positioned in the same plane.

In an alternate embodiment of the invention, the end sections are bent circumferentially away from the intermediate sections forming a predetermined bend on each side of the shaft. The bend or curvature moving away from the center section is away from the intended direction of rotation of the tool. The predetermined bend may constitute a curve and the two curves on opposite sides of the bundle may form a generally S-shaped curve. Alternatively, the predetermined bend may be an angle relative to the intermediate section of the bundle between 100° and 170°, and more preferably approximately 135°.

In another embodiment of the invention, the securing section of the wire stem may be twisted whereby the bundle of monofilaments projects radially outwardly in a helical pattern along the longitudinal axis of the wire.

In yet another embodiment of the invention, a flexible abrasive grinding tool having a tool face is disclosed comprising a layer of stiff yet yielding abrasive loaded plastic monofilaments secured to a shaft. Each of the filaments has two side sections projecting radially in opposite directions from the longitudinal axis of the shaft. The filaments are then circumferentially curved whereby at the tool face the filaments extend circumferentially in a predetermined curve.

The present invention also provides a method of forming a rotary abrasive tool. A group of straight monofilaments incorporating abrasive material homogeneously throughout is formed into a relatively thin bundle. The bundle is enclosed in a looped or bent center portion of a wire and ends beyond the bundle are twisted to form a twisted stem. The tool is placed in a fixture having a central hole and two diametrically opposed fixed pins to receive the stem. Two diametrically opposed larger pins on opposite sides of the hole are rotated against the opposite sides of the bundle to cause the bundle to bend. The filaments are heat and quench processed so as to take the bent form of two larger pins on opposite sides of the hole.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

In the annexed drawings:

FIG. 7 is a perspective view of another tool according to the present invention;

FIG. 8 is a top view of the tool of FIG. 7;

FIG. 9 is a perspective view of another embodiment of a rotary tool according to the present invention;

FIG. 10 is a top view of the rotary tool of FIG. 9;

FIG. 11 is a perspective view of a further tool according to the present invention;

FIG. 12 is a top view of the tool of FIG. 11;

FIG. 13 is a fragmented axial view of the tool of FIG. 12 following insertion into a cylinder and rotation of the tool illustrating the shape of the tool in such application;

DETAILED DESCRIPTION OF PREFERRED EMBODIMENT

Figure 1:
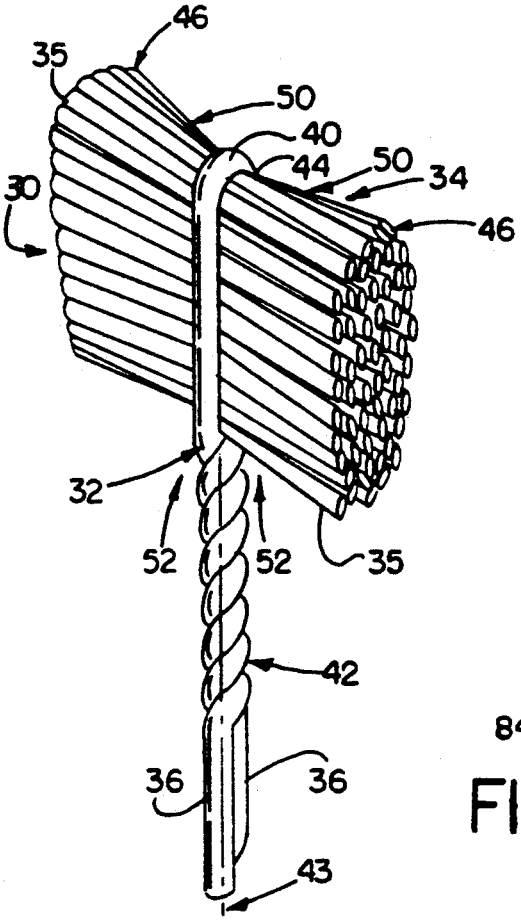
FIG. 1 is a perspective view of a rotary tool of the present invention.
Figure 2:
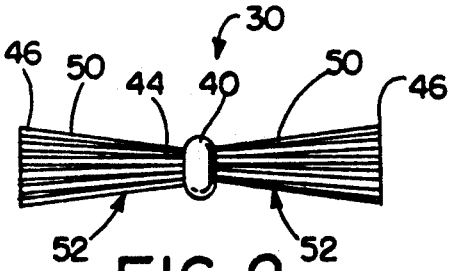
FIG. 2 is a top view of the tool of FIG. 1.

Referring to the drawings and initially to FIGS. 1 and 2, a tool 30 according to the present invention is shown. The tool 30 includes a shaft 32 which is adapted to be mounted for rotation of the tool in a counterclockwise direction. Tool 30 also includes a relatively thin flat bundle 34 of monofilaments 35. The shaft 32 includes two stem sections 36 and a securing section 40 in between the stem sections. The securing section 40 encloses the bundle 34 and the stem sections 36 are twisted beyond the bundle 34 to form a twisted stem 42. The shaft 32 has a longitudinal axis 43 shown generally by the dashed line in FIG. 1.

The bundle 34 has a central section 44 which is enclosed by the securing section 40 of the shaft 32. The bundle has two end sections 46 and intermediate sections 50 between the central and end sections. The intermediate sections 50 project radially outward from two sides 52 of shaft 32.

Figure 1A:
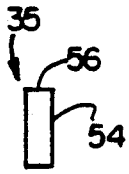
FIG. 1A is an enlarged transverse section of a preferred abrasive loaded filament for use with the present invention.
Figure 1B:
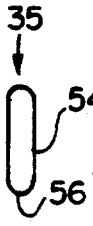
FIG. 1B is a similar section of other forms of filaments.
Figure 14:
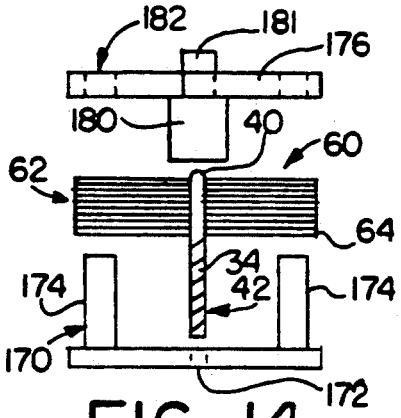
FIG. 14 is an exploded view of a fixture used to form a rotary abrasive tool according to the present invention.

The filaments or monofilaments 35 in bundle 34 are preferably rectangular plastic monofilaments, or in other words, have a generally rectangular sectional shape. FIGS. 1A and 1B show typical sectional shapes in the monofilaments 35. The rectangular shape of the section of the filament 35 may be viewed as having a width dimension 54 and a thickness dimension 56. FIG. 14 shows a filament with an almost perfect rectangular sectional shape, while the corners of the filament of FIG. 1B are rounded. The width 54 of the rectangular monofilament 35 is preferably twice the thickness of the monofilament. The monofilament 35 is preferably positioned so that the width dimension 54 is parallel to the longitudinal axis 43 of the shaft 32. In this manner the width dimension 54 of the monofilament 35 is also positioned parallel to the axis of work when inserted into a cylinder.

Typically, the rectangular filament at its major flat face may be approximately 0.090 inch wide and about 0.045 inch thick. Somewhat wider rectangular filaments may be employed having major flat faces up to three to four times the thickness of the filament. Thus, the width is not greater than four times the thickness. More preferably the width is not greater than three times the thickness and still more preferably the width is approximately twice the thickness. The length of the monofilament, projecting from the shaft, is at least ten times greater than the width, and more preferably at least twenty times greater than the width.

The monofilament may be extruded plastic such as nylon impregnated throughout uniformly with an abrasive mineral such as aluminum oxide or silicon carbide. Other more exotic abrasive minerals may readily be employed such as polycrystalline diamond. Also, the abrasive grit size may be varied from coarse to fine powders for extra fine polishing and highlighting effects on work parts.

The monofilaments are formed by an extrusion process. Extrusion involves converting a material into a continuous homogeneous melt. The melt is forced through a die which yields a desired shape. The melt is then cooled back to its solid state as it is held in the desired shape. Extrusion machines commonly include an extrusion screw which forms the melt and which is the heart of the extrusion process. The screw ensures, among other things, optimum melt quality, mixing requirements of the melt and consistency of the extruded output.

To make an extruded abrasive nylon monofilament, the nylon is heated to a temperature somewhere in the range of 450° F. to 475° F. The abrasive minerals are then introduced and uniformly mixed and each particle of abrasive will be surrounded by the nylon. In other words, the abrasive particles will not directly touch each other, each being coated by the melt. This continuous uniform melt is then forced through a die which yields a monofilament having a transverse rectangular cross section. The melt is then cooled back to the solid state as it is held in this desired shape. The resulting filament has a very uniform distribution of abrasive minerals.

Extrusion is a different process than pressing which is sometimes used to form abrasive elements. Pressing is normally done at room temperature and abrasive particles are pressed into a material, sometimes with the help of glue or binders. In pressing, the particles have a tendency to line up adjacent each other creating an inherent fracture line in the resulting product. Moreover, the resulting distribution will not be uniform. This is true even if a mixture having a very uniform distribution of particles is used, as the pressing force will encourage the particles to line up.

The plastic material preferably has a Young's modulus greater than 0.10 at $10^6$ psi and more preferably greater than 0.40 at $10^6$ psi. Young's modulus is defined as the amount of force a material can undergo without permanent deformation when the force is removed. This is a measure of elasticity or the relationship of stress over strain.

The preferred plastic for extrusion of the monofilament working element is nylon. The preferred nylon is 6/12 nylon. Nylons are long-chain partially crystalline synthetic polymeric amides (polyamides). Polyamides are formed primarily by condensation reactions of diamines and dibasic acids or a material having both the acid and amine functionality.

Nylons have excellent resistance to oils and greases, in solvents and bases. Nylons have superior performance against repeated impact, abrasion, and fatigue. Other physical properties include a low coefficient of friction, high tensile strength, and toughness. Useful mechanical properties of nylon include strength, stiffness and toughness. In general, the greater the amount of amide linkages, the greater the stiffness, the higher the tensile strength, and the higher the melting point. Several useful forms of nylon are available and include:

A. Nylon 6/6 synthesized from hexamethylenediamine (HMD) and adipic acid;
B. Nylon 6/9 synthesized from HMD and azelaic acid;
C. Nylon 6/10 synthesized from HMD and sebacic acid;
D. Nylon 6/12 synthesized from HMD and dodecanedioic acid;
E. Nylon 6 synthesized from polycaprolactam;
F. Nylon 11 synthesized from 11-aminoundecanoic acid;
G. Nylon 12 synthesized from polyaurolactam; and others.

Nylons useful in the present invention have a Young's modulus greater than 0.05, preferably greater than 0.1 and preferably greater than 0.2.

The preferred nylon is nylon 6/12. The physical properties of nylon 6/12 include a melting point of 212° C., a dry yield strength at $10^3$ psi of 8.8 (7.4 at 50% RH), a dry flexural modulus of 295 (180 at 50% RH). Nylon has a higher Young's modulus (0.40 at $10^6$ psi) than rubber (0.01 at $10^6$ psi), which demonstrates the greater stiffness of nylon over an elastomer such as rubber, for example. As an example, a working element according to the present invention several feet long when held horizontally at one end at room temperature would show little or minimal deflection at the opposite end.

Nylon is partially crystalline, hence has little or no rubbery regions during deformation. The degree of crystallinity determines the stiffness and yield point. As the crystallinity decreases the stiffness and yield stress decreases. Rubber, on the other hand, is an amorphous polymer and its molecular straightening leads to a low modulus of elasticity.

Nylon has a tensile strength of over 8000 psi, rubber has a tensile strength of 300 psi. Nylon exhibits 250% breakage during elongation, rubber exhibits 1200%. Nylon has fair moisture resistance, yet rubber absorbs a large amount of water. Nylon has excellent resistance to oil and greases and other organic solvents, rubber has extremely poor resistance. Nylon retains its properties from −75° F. to 230° F., while rubber has a narrow range around room temperature. Nylon's increased strength, resistance to moisture and solvents, and its wide usable temperature range make it the preferred material for this construction.

Another type of polyamide useful in the present invention include other condensation products with recurring amide groups along the polymer chain, such as aramids. Aramids are defined as a manufactured fiber in which at least 85% of the amide (—C(O)—N(H)—) linkages are attached directly to two aromatic hydrocarbon rings. This is distinguished from nylon which has less than 85% of the amide linkages attached directly to the two aromatic rings.

The plastic material may also be aramid fibers which are characterized by high tensile strength and high modulus. Two Aramids that may be useful in the present invention include fiber formed from the polymerization of p-phenylenediamine with terephthaloyl chloride and a less stiff polymer formed from the polymerization of m-phenylenediamine and isophthaloyl chloride.

Aramids demonstrate a very strong resistance to solvents. Aramids have tensile strengths at 250° C. that are exhibited by textile fibers at room temperature.

Also, some thermoset polymers are useful. Polyesters are an example and are long chain synthetic polymers with at least 85% of a dihydric alcohol ester (HOROH) and terephthalic acid (p-$HOOCC_6H_4COOH$). Polyester fibers contain both crystalline and non-crystalline regions. Polyesters are resistant to solvents and demonstrate a breaking elongation of 19 to 40%.

Polyimides are polymers containing (CONHCO) and are also useful in the present invention. High temperature stability (up to 700° F.) and high tensile strength of 13,500 psi make polyimides useful as binders in abrasive wheels.

It has also been discovered that with the rectangular or flat face filament the loading of the abrasive mineral in the plastic matrix may be increased. Traditionally, approximately 30% of abrasive mineral has been the standard criteria used in the round and crimped abrasive nylon monofilaments. The percentage is measured by weight and is relative to the cross sectional area of the nylon monofilaments.

The rectangular abrasive nylon monofilament with its relatively larger cross sectional area permits upwards of 45% loading of abrasive mineral without a negative effect on the overall filament strength. This represents a 50% gain in abrasive mineral content and the rectangular filament more effectively presents that abrasive to the work surface.

It should be noted that the term monofilament as used in the rotary abrasive tool art refers to something considerably larger and more stiff than a fiber or that which can be measured with a denier. Fibers are usually limp or highly flexible.

The filaments 35 preferably have abrasive material embedded substantially homogeneously therein throughout in excess of 30% and preferably about 45% abrasive minerals.

In FIG. 1, the bundle 34 extends outwardly perpendicularly to the longitudinal axis of the shaft 32. The tool has a generally T shape, the bundle 34 forming the head of the T, and the twisted stem 42 forming the stem of the T. The intermediate sections 50 of the bundle 34 lie generally in a plane passing through the longitudinal axis 43 of the shaft 32. In the embodiment of FIG. 1, the end sections 46 also lie in the same plane.

Figure 3:
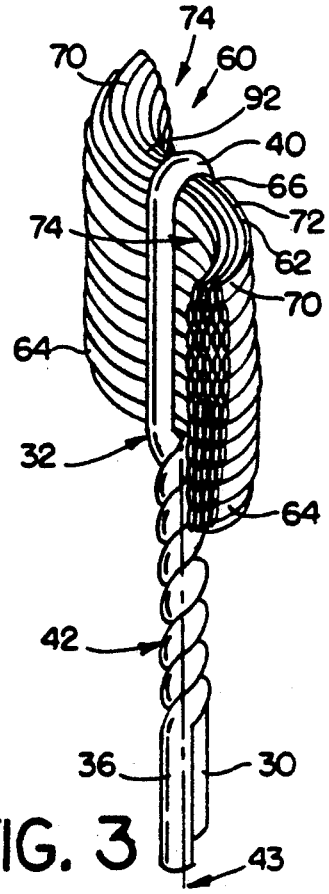
FIG. 3 is a perspective view of another form of rotary tool of the present invention.

Referring now to FIG. 3, a tool 60, which is another embodiment of the present invention, is illustrated. The tool 60 includes a shaft 32, and a twisted stem 42. The shaft 32 is adapted for rotation in a clockwise direction as viewed in FIG. 1. Secured to the shaft 32 is a bundle 62 formed of abrasive loaded plastic monofilaments 64 piled approximately three to four layers thick. The monofilaments 64 preferably have a rectangular sectional shape.

The bundle 62 has a central section 66, end sections 70 and intermediate section 72. The intermediate section 72 projects radially outwardly from the two sides of the shaft 32 perpendicular to the longitudinal axis 43 of the shaft 32. The end sections 70 are bent circumferentially away from the intermediate section 72, forming a predetermined curve 74 on each side of the shaft 32. The end sections 70 are preferably bent in a direction away from the rotation of the tool. In the illustrated embodiment, this direction would be clockwise. Curves 74 are on opposite surfaces of the bundle 72 on the two sides of the shaft 32 forming a generally elongated S-shaped curve.

Figure 4:
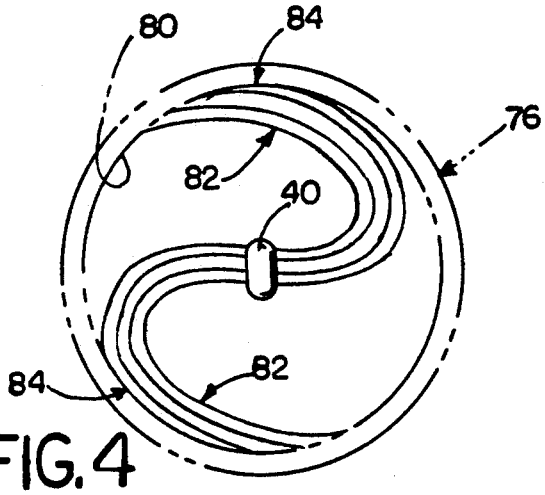
FIG. 4 is an axial view of the tool of FIG. 3 following insertion into a cylinder illustrating the shape of the tool of such an application.

FIG. 4 shows the tool 60 inserted into a cylinder 76 having an interior surface 80. Once the tool 60 is inserted, the degree of curvature of the end section 70 is even more pronounced. As the tool 60 is rotated in the clockwise direction, the top layers 82 of the monofilaments lie over the adjacent layers 84. The underlying filaments in layers 84 act as springs or cushions urging the filaments in the top layers 82 against the work surface—i.e., the interior surface 80 of the cylinder 76. The rectangular filaments 64 are positioned so that their longer width dimension is parallel to the longitudinal axis 43 of the shaft 32. This positioning permits the wider face of the rectangular filament to perform the wiping action.

Figure 6:
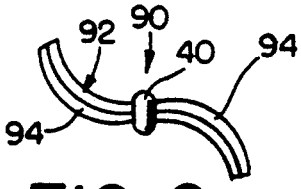
FIG. 6 is a top view of the tool of FIG. 5.
Figure 5:
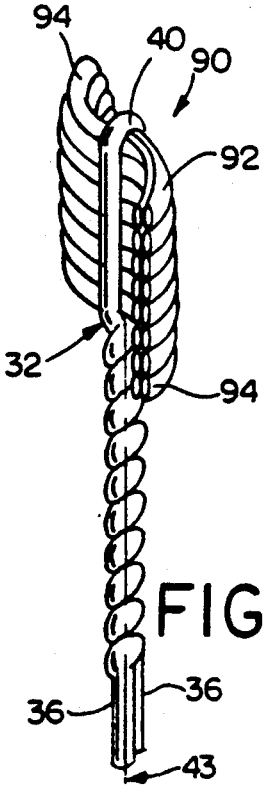
FIG. 5 is a perspective view of a rotary tool similar to that of FIG. 3 but with a thinner bundle.

In FIGS. 5 and 6, another tool 90 according to the present invention is illustrated. The tool 90 is similar to the tool 60. Secured to the shaft 32 is a bundle 92 which is two layers thick of monofilaments 94.

In FIGS. 7 and 8, a tool 100 according to the present invention is illustrated. The tool 100 is designed to rotate in a clockwise direction and includes a bundle 102 of approximately two layers thick of monofilaments 104. The bundle 102 has a central section 106, intermediate sections 110, and end sections 112. The intermediate sections 110 project radially outward from the two sides of the shaft 32 perpendicular to the longitudinal axis 43 of the shaft 32. The end sections 112 bend circumferentially away from the intermediate sections 110 to form a predetermined angle 114 on each side of the shaft 32. An angle, rather than a curve, may be easier to make and better suited for some applications. When measured relative to the surface of the intermediate section 110 on the concave side of the bend, the predetermined angle 114 is obtuse. The angle 114 is preferably between roughly 100° and 170°, and more preferably is approximately 135°. The bend is in the direction opposite the intended rotation of the tool 100, and when viewed from the top the two sides of the bundle 102 form a generally zig-zag pattern as shown in FIG. 8.

In FIGS. 9 and 10, a tool 120 adapted to be rotated in the clockwise direction is illustrated. The tool 120 has a bundle 122 which is two layers thick of monofilaments 124. The bundle 122 is secured to a shaft 126 having a longitudinal axis 127. The shaft 126 is a wire having two stem sections 130, and a securing section 132. The securing section 132 encloses the bundle 122 and the stem sections 130 are twisted beyond the bundle 122 to form a twisted stem 134. In the tool 120, the securing section 132 is also twisted in the counterclockwise direction whereby monofilaments 124 project radially outward in a helical pattern along the longitudinal axis 127 of the shaft 126. The monofilaments 124 are positioned sequentially spaced slightly apart in the radial direction (counterclockwise) and the axial direction (towards the twisted stem 134). The securing section 132 of tool 120 is not twisted a complete turn, resulting in the monofilaments 124 being arranged in a bow tie pattern when viewed from the top of the tool (see FIG. 10).

In FIGS. 11–13, another tool 140 according to the present invention is illustrated. The tool 140 is similar to the tool 120 of FIGS. 9 and 10, and is designed for rotation in the counterclockwise direction. The tool 140 has a bundle 142 which is approximately three layers thick of monofilaments 144. The monofilaments 144 are relatively small in cross-sectional direction when compared with the monofilaments 124 of tool 120 in FIGS. 9 and 10. The tool 140 has a shaft 146 with two stem sections 150 and a securing section 152. The two stem sections 150 are twisted to form a twisted stem 154. The securing section 152 is twisted one and a half times to form a helical pattern. When viewed from the top of the tool 140, as in FIG. 12, a circular shape is formed by the projecting monofilaments 144.

In FIG. 13, a fragmented section of tool 140 is illustrated in a cylinder 156 having an interior surface 160. The bundle 142 has end sections 162 and intermediate sections 164 which project radially outward from the shaft 146. When inserted in the cylinder 156, the end sections 162 flex in the direction of rotation of the tool, and the working face of each of the monofilaments 144 is the side of the monofilament.

FIGS. 14–20 show steps in forming a rotary abrasive tool having a bundle with end sections bent away from intermediate sections of the bundle, similar to the tool 60 shown in FIG. 3. For clarity in explanation, the method of making the tool 60 of FIG. 3 is explained, with like numerals incorporated into the method. However, those skilled in the art will appreciate this method may be employed in making many forms of tools, such as, for instance, the tool 90 shown in FIG. 5.

To make the rotary abrasive tool 60, a group of straight monofilaments 64 is formed into a relatively thin flat bundle 62. The bundle 62 is enclosed in the center securing section 40 of the shaft 34 and the stem sections 36 are twisted to form a twisted stem 42.

Figure 15:
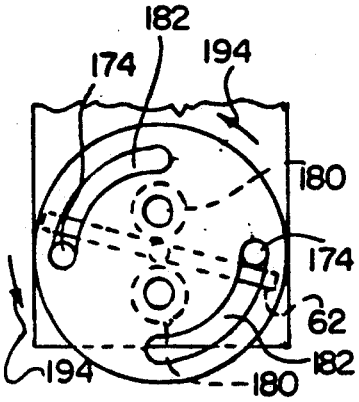
FIG. 15 is a top view of the fixture of FIG. 14 after the tool has been inserted into it.
Figure 16:
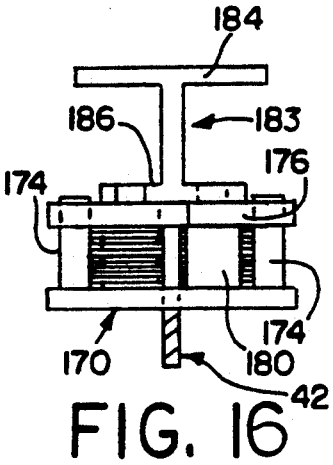
FIG. 16 is a front view of the fixture with the tool inserted and a turning tool attached and rotated in the counterclockwise direction.
Figure 17:
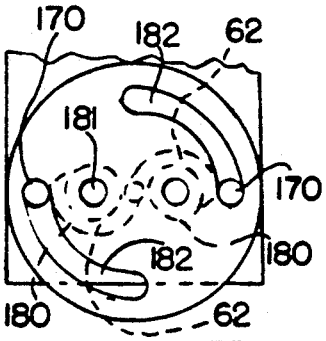
FIG. 17 is a top view of the fixture after the turning tool has been rotated in the counterclockwise direction.
Figure 18:
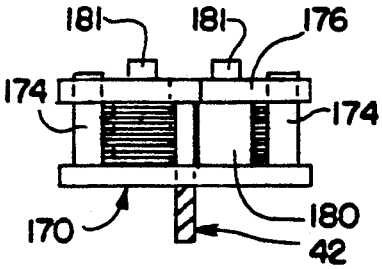
FIG. 18 is a front view of the fixture after the turning tool has been rotated and removed.

FIG. 14 shows an exploded view of a fixture 170 used to form the tool 60. The fixture 170 has a central hole 172 to receive the twisted stem 42. The fixture 170 also has two diametrically opposed pins 174 positioned on opposite sides of the hole 172. As is best seen in FIG. 15, the tool 60 is positioned in the fixture 170 so that the bundle 62 extends adjacent to, but beyond, the pins 174. A cover 176 is placed on the fixture 170 and over the bundle 62. The cover 176 has two larger cylindrical projections, or pins, 180 extending perpendicularly downwardly from the cover. The cylindrical projections 180 fit on opposite sides of the bundle 42. Smaller cylindrical projections, or plugs, 181 extend perpendicularly upwardly from the cover 176, coaxial with respective projections 180. The cover 176 also has two banana slots 182, which receive pins 174 when the cover is placed on the fixture 170. The slots 182 extend in a 90° arc and allow the pins 174 to move only within this arc once the cover 176 is in place. The size of the slots 182 may be varied depending on the type of curvature desired. As is best seen in FIG. 15, the pins 174 are initially positioned at the ends of slots 182 so that the projections 180 and the pins 174 are aligned in opposite vertical planes.

A turning tool 183 is used to rotate the cover 176 relative to the fixture 170. The turning tool 183 is an I-beam shape with a top flange 184, a bottom flange 186 and a stem 190. The bottom flange 186 includes two holes 192 which receive the plugs 181. Force may be applied to the top flange 184 to turn the cover 176 in the direction of arrow 194 as shown in FIG. 15.

Figure 19:
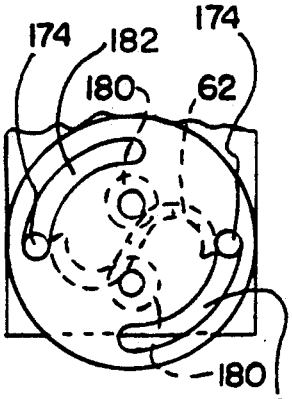
FIG. 19 is an exploded view of the fixture and the formed tool after the cover has been rotated to its original position in FIG. 1.
Figure 20:
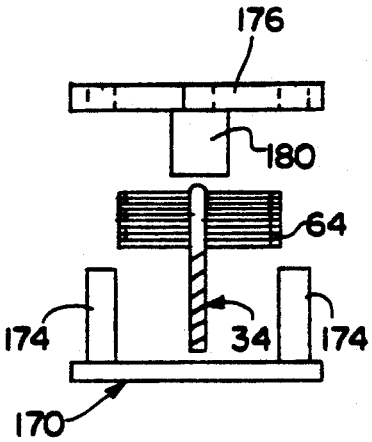
FIG. 20 is a top view of the fixture of FIG. 19.

The cover 176, and the cylindrical projections 180 are turned approximately 90° so that the pins 174 slide to the opposite ends of slots 182. In this manner, the projections 180 and the pins 174 are now aligned in the same vertical plane (see FIGS. 16–18). This causes the end sections 70 of the bundle 62 to assume the curved shape of the cylindrical projections 180. Because the projections 180 are on opposite sides of the bundle 62, an S-shape configuration is formed as shown by the dashed line in FIG. 17. The cover 176 is then locked in place. Heat is applied to the bundle 62 and then the bundle is quenched. The cover 176 is then unlocked, and untwisted, as shown in FIG. 19 the pins 174 returning to their original positioning in the slots 182. The tool 60 is then removed and the bundle retains the S-shape configuration.

One may appreciate that the present invention provides a rotary abrasive tool which can be effectively used to clean the interiors of cylinders. The tool includes monofilaments in which the side of the monofilament instead of the tip is positioned against the surface to be honed or finished, thereby achieving more work per unit time.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims.

What is claimed is:

1. An abrasive grinding tool comprising:

a shaft having a longitudinal axis; and a relatively thin flat bundle of extruded plastic monofilaments having a central section, two end sections and two intermediate sections between said central section and said end sections;

said central section of said bundle being secured to said shaft whereby said intermediate sections project radially outwardly from two sides of said shaft in a direction generally perpendicular to said longitudinal axis;

each monofilament in said bundle having a generally transverse rectangular cross-sectional shape and having an abrasive material embedded substantially uniformly therein throughout.

2. A grinding tool as set forth in claim 1 wherein said shaft comprises a wire having two stem sections and a securing section between said stem sections, said securing section enclosing said bundle and said stem sections being twisted beyond said bundle to form a twisted stem.

3. A rotary abrasive tool as set forth in claim 1 wherein the rectangular cross-sectional shape has a width dimension and a thickness dimension, said width dimension being at least twice the magnitude of said thickness dimension whereby each monofilament is at least twice as wide as it is thick.

4. An abrasive grinding tool as set forth in claim 3 wherein said monofilaments are oriented so that the width dimension is generally parallel to said longitudinal axis.

5. An abrasive grinding tool as set forth in claim 4 wherein said monofilaments are loaded with at least 30% by weight of abrasive material.

6. An abrasive grinding tool as set forth in claim 6 wherein said monofilaments are loaded with about 45% by weight of abrasive material.

7. An abrasive grinding tool as set forth in claim 6 wherein said intermediate sections are generally positioned in a plane passing through said longitudinal axis; and said end sections are generally positioned in the same plane.

8. An abrasive grinding tool as set forth in claim 1 wherein said monofilaments are positioned slightly radially and axially apart from adjacent monofilaments whereby a helical pattern is formed.

9. An abrasive grinding tool as set forth in claim 2 wherein said securing section of said wire is twisted whereby said monofilaments project radially outwardly in a helical pattern along said longitudinal axis of said shaft.

10. An abrasive grinding tool having a tool face, comprising:

a layer of stiff yet yielding abrasive loaded extruded plastic filaments secured to a shaft;

each of the filaments having two side sections projecting radially in opposite directions from a longitudinal axis of said shaft and then being circumferentially curved whereby at the tool face the filaments extend circumferentially in a predetermined bend; and each of the filaments having an abrasive material embedded substantially uniformly therein throughout.

11. An abrasive grinding tool as set forth in claim 10 wherein said shaft is a wire having two stem sections and a securing section therebetween, said securing section enclosing said filaments and said stem sections being twisted beyond said filaments to form a twisted stem.

12. An abrasive grinding tool as set forth in claim 10 wherein said filaments have at least one flat side.

13. An abrasive grinding tool as set forth in claim 12 wherein said filaments have a generally rectangular transverse sectional shape.

14. An abrasive grinding tool as set forth in claim 13, wherein said filament is at least twice as wide as it is thick.

15. An abrasive grinding tool as set forth in claim 14 wherein said filaments are oriented so that the width dimension is generally parallel to said longitudinal axis.

16. An abrasive grinding tool as set forth in claim 15 wherein said filaments are loaded with at least 30% by weight of abrasive material.

17. An abrasive grinding tool as set forth in claim 16 wherein said filaments are loaded with approximately 45% by weight of abrasive material.

18. An abrasive grinding tool as set forth in claim 10 wherein the side sections are bent circumferentially away from the intended direction of rotation of the tool.

19. An abrasive grinding tool as set forth in claim 17 wherein said predetermined bend is a curve having a concave surface and a convex surface, said concave surface is on opposite sides of said bundle, whereby a generally S-shape curve is formed.

20. An abrasive grinding tool as set forth in claim 18 wherein said bend is an angle relative to an intermediate section and said angle is obtuse.

21. An abrasive grinding tool as set forth in claim 20 wherein said angle is between 100° and 170°.

22. An abrasive grinding tool as set forth in claim 21 wherein said angle is approximately equal to 135°.

23. An abrasive grinding tool as set forth in claim 10 wherein said tool includes at least two layers of said filaments.

24. An abrasive grinding tool as set forth in claim 1 wherein the plastic material of the monofilament is nylon.

25. An abrasive grinding tool as set forth in claim 10 wherein the plastic material of the monofilament is nylon.

26. A tool as set forth in claim 1 wherein each monofilament has a length projecting radially from said shaft and a rectangular transverse section of a certain width and thickness, said length being at least ten times greater than said width, and said width being not greater than four times said thickness.

27. A tool as set forth in claim 26 wherein each monofilament is made of a plastic material having an abrasive material embedded substantially homogeneously therein throughout and has a Young's modulus greater than 0.10 at $10^6$ psi.

28. A tool as set forth in claim 27 wherein said plastic material has a Young's modulus greater than 0.40 at $10^6$ psi.

29. A tool as set forth in claim 10 wherein each filament has a length dimension projecting from said shaft and a transverse sectional shape with at least one flat side forming a flat surface, said length being at least ten times longer than said side.

30. A tool as set forth in claim 29 wherein each monofilament is made of a plastic material having an abrasive material embedded substantially homogeneously therein throughout and has a Young's modulus greater than 0.10 at $10^6$ psi.

31. A tool as set forth in claim 30 wherein said plastic material has a Young's modulus greater than 0.40 at $10^6$ psi.

32. An abrasive grinding tool comprising:

a shaft having a longitudinal axis; and a relatively thin flat bundle of plastic monofilaments having a central section, two end sections and two intermediate sections between said central section and said end sections;

said central section of said bundle being secured to said shaft whereby said intermediate sections project radially outwardly from two sides of said shaft in a direction generally perpendicular said longitudinal axis;

each monofilament in said bundle having a generally rectangular transverse cross-sectional shape and having an abrasive material embedded substantially homogeneously therein throughout;

wherein the rectangular cross-sectional shape has a width dimension and a thickness dimension, said width dimension being at least twice the magnitude of said thickness dimension whereby each monofilament is at least twice as wide as it is thick;

wherein said monofilaments are oriented so that the width dimension is generally parallel to said longitudinal axis;

wherein said monofilaments are loaded with at least 30% by weight of abrasive material;

wherein said end sections bend circumferentially away from said intermediate sections forming a predetermined bend on each side of said shaft;

wherein said end sections bend circumferentially away from the intended direction of rotation of the tool;

wherein said predetermined bend is an angle, said angle being obtuse relative to a convex surface of the intermediate section.

33. An abrasive grinding tool as set forth in claim 32 wherein said angle is between 100° and 170°.

34. An abrasive grinding tool as set forth in claim 33 wherein said angle is approximately 135°.

35. An abrasive grinding tool comprising:

a shaft having a longitudinal axis; and a relatively thin flat bundle of plastic monofilaments having a central section, two end sections and two intermediate sections between said central section and said end sections;

said central section of said bundle being secured to said shaft whereby said intermediate sections project radially outwardly from two sides of said shaft in a direction generally perpendicular said longitudinal axis;

each monofilament in said bundle having a generally rectangular transverse cross-sectional shape and having an abrasive material embedded substantially homogeneously therein throughout;

wherein said monofilaments are positioned slightly radially and axially apart from adjacent monofilaments whereby a helical pattern is formed.

36. An abrasive grinding tool comprising:

a shaft having a longitudinal axis; and a relatively thin flat bundle of plastic monofilaments having a central section, two end sections and two intermediate sections between said central section and said end sections;

said central section of said bundle being secured to said shaft whereby said intermediate sections project radially outwardly from two sides of said shaft in a direction generally perpendicular said longitudinal axis;

each monofilament in said bundle having a generally rectangular transverse cross-sectional shape and having an abrasive material embedded substantially homogeneously therein throughout;

wherein said shaft comprises a wire having two stem sections and a securing section between said stem sections, said securing section enclosing said bundle and said stem sections being twisted beyond said bundle to form a twisted stem;

wherein said securing section of said wire is twisted whereby said monofilaments project radially outwardly in a helical pattern along said longitudinal axis of said shaft.

37. An abrasive grinding tool having a tool face, comprising:

a layer of stiff yet yielding abrasive loaded plastic filaments secured to a shaft;

each of the filaments having two side sections projecting radially in opposite directions from a longitudinal axis of said shaft and then being circumferentially curved whereby at the tool face the filaments extend circumferentially in a predetermined bend; and each of the filaments having an abrasive material embedded substantially homogeneously therein throughout;

wherein the side sections are bent circumferentially away from the intended direction of rotation of the tool;

wherein said bend is an angle relative to an intermediate section and said angle is obtuse.

38. An abrasive grinding tool as set forth in claim 37 wherein said angle is between 100° and 170°.

39. An abrasive grinding tool as set forth in claim 38 wherein said angle is approximately equal to 135°.

40. An abrasive grinding tool comprising:
a shaft having a longitudinal axis; and
a relatively thin flat bundle of extruded plastic monofilaments having a central section, two end sections and two intermediate sections between said central section and said end sections;
said central section of said bundle being secured to said shaft whereby said intermediate sections project radially outwardly from two sides of said shaft in a direction generally perpendicular to said longitudinal axis;
each monofilament in said bundle having a generally transverse rectangular cross-sectional shape and having an abrasive material embedded substantially uniformly therein throughout, wherein the rectangular cross-sectional shape has a width dimension and a thickness dimension, said width dimension being at least twice the magnitude of said thickness dimension whereby each monofilament is at least twice as wide as it is thick, wherein said monofilaments are oriented so that the width dimension is generally parallel to said longitudinal axis, wherein said monofilaments are loaded with at least 30% by weight of abrasive material, wherein said end sections bend circumferentially away from said intermediate sections forming a predetermined bend on each side of said shaft.

41. An abrasive grinding tool comprising:
a shaft having a longitudinal axis; and
a relatively thin flat bundle of extruded plastic monofilaments having a central section, two end sections and two intermediate sections between said central section and said end sections;
said central section of said bundle being secured to said shaft whereby said intermediate sections project radially outwardly from two sides of said shaft in a direction generally perpendicular to said longitudinal axis;
each monofilament in said bundle having a generally transverse rectangular cross-sectional shape and having an abrasive material embedded substantially uniformly therein throughout, wherein the rectangular cross-sectional shape has a width dimension and a thickness dimension, said width dimension being at least twice the magnitude of said thickness dimension whereby each monofilament is at least twice as wide as it is thick, wherein said monofilaments are oriented so that the width dimension is generally parallel to said longitudinal axis, wherein said monofilaments are loaded with at least 30% by weight of abrasive material, wherein said end sections bend circumferentially away from said intermediate sections forming a predetermined bend on each side of said shaft wherein said end sections bend circumferentially away from the intended direction of rotation of the tool.

42. An abrasive grinding tool comprising:
a shaft having a longitudinal axis; and
a relatively thin flat bundle of extruded plastic monofilaments having a central section, two end sections and two intermediate sections between said central section and said end sections;
said central section of said bundle being secured to said shaft whereby said intermediate sections project radially outwardly from two sides of said shaft in a direction generally perpendicular to said longitudinal axis;
each monofilament in said bundle having a generally transverse rectangular cross-sectional shape and having an abrasive material embedded substantially uniformly therein throughout, wherein the rectangular cross-sectional shape has a width dimension and a thickness dimension, said width dimension being at least twice the magnitude of said thickness dimension whereby each monofilament is at least twice as wide as it is thick, wherein said monofilaments are oriented so that the width dimension is generally parallel to said longitudinal axis, wherein said monofilaments are loaded with at least 30% by weight of abrasive material, wherein said end sections bend circumferentially away from said intermediate sections forming a predetermined bend on each side of said shaft wherein said end sections bend circumferentially away from the intended direction of rotation of the tool wherein said predetermined bend on each side of said shaft is a curve.

43. An abrasive grinding tool comprising:
a shaft having a longitudinal axis; and
a relatively thin flat bundle of extruded plastic monofilaments having a central section, two end sections and two intermediate sections between said central section and said end sections;
said central section of said bundle being secured to said shaft whereby said intermediate sections project radially outwardly from two sides of said shaft in a direction generally perpendicular to said longitudinal axis;
each monofilament in said bundle having a generally transverse rectangular cross-sectional shape and having an abrasive material embedded substantially uniformly therein throughout, wherein the rectangular cross-sectional shape has a width dimension and a thickness dimension, said width dimension being at least twice the magnitude of said thickness dimension whereby each monofilament is at least twice as wide as it is thick, wherein said monofilaments are oriented so that the width dimension is generally parallel to said longitudinal axis, wherein said monofilaments are loaded with at least 30% by weight of abrasive material, wherein said end sections bend circumferentially away from said intermediate sections forming a predetermined bend on each side of said shaft wherein said end sections bend circumferentially away from the intended direction of rotation of the tool wherein said predetermined bend on each side of said shaft is a curve wherein said predetermined bend is an angle, said angle being obtuse relative to a convex surface of the intermediate section.

44. An abrasive grinding tool comprising:
a shaft having a longitudinal axis; and
a relatively thin flat bundle of extruded plastic monofilaments having a central section, two end sections and two intermediate sections between said central section and said end sections;
said central section of said bundle being secured to said shaft whereby said intermediate sections project radially outwardly from two sides of said shaft in a direction generally perpendicular to said longitudinal axis;
each monofilament in said bundle having a generally transverse rectangular cross-sectional shape and having an abrasive material embedded substantially uniformly therein throughout, wherein the rectangular cross-sectional shape has a width dimension and a thickness dimension, said width dimension being at least twice the magnitude of said thickness dimension whereby each monofilament is at least twice as wide as it is thick, wherein said monofilaments are oriented so that the width dimension is generally parallel to said longitudinal axis, wherein said monofilaments are loaded with at least 30% by weight of abrasive material, wherein said end sections bend circumferentially away from said intermediate sections forming a predetermined bend on each side of said shaft wherein said end sections bend circumferentially away from the intended direction of rotation of the tool wherein said predetermined bend on each side of said shaft is a curve wherein said predetermined bend is an angle, said angle being obtuse relative to a convex surface of the intermediate section wherein said angle is between 100° and 170°.

45. An abrasive grinding tool comprising:

a shaft having a longitudinal axis; and a relatively thin flat bundle of extruded plastic monofilaments having a central section, two end sections and two intermediate sections between said central section and said end sections;

said central section of said bundle being secured to said shaft whereby said intermediate sections project radially outwardly from two sides of said shaft in a direction generally perpendicular to said longitudinal axis;

each monofilament in said bundle having a generally transverse rectangular cross-sectional shape and having an abrasive material embedded substantially uniformly therein throughout, wherein the rectangular cross-sectional shape has a width dimension and a thickness dimension, said width dimension being at least twice the magnitude of said thickness dimension whereby each monofilament is at least twice as wide as it is thick, wherein said monofilaments are oriented so that the width dimension is generally parallel to said longitudinal axis, wherein said monofilaments are loaded with at least 30% by weight of abrasive material, wherein said end sections bend circumferentially away from said intermediate sections forming a predetermined bend on each side of said shaft wherein said end sections bend circumferentially away from the intended direction of rotation of the tool wherein said predetermined bend on each side of said shaft is a curve wherein said predetermined bend is an angle, said angle being obtuse relative to a convex surface of the intermediate section, said angle being between 100° and 170°.

* * * * *